United States Patent [19]

Fuchs et al.

[11] Patent Number: 4,850,279

[45] Date of Patent: Jul. 25, 1989

[54] SUBCALIBER PROJECTILE WITH PIVOTALLY SEPARABLE DRIVE CAGE

[75] Inventors: Reinhart Fuchs, Unterhaching; Hans W. Luther, Kaarst; Rudolf Romer, Kaarst; all of Fed. Rep. of Germany

[73] Assignee: Firma Rheinmetall GmbH, Duesseldorf, Fed. Rep. of Germany

[21] Appl. No.: 84,534

[22] Filed: Aug. 12, 1987

Related U.S. Application Data

[60] Division of Ser. No. 809,476, Dec. 16, 1985, Pat. No. 4,724,770, Continuation-in-part of Ser. No. 280,378, Jun. 22, 1981, abandoned.

[30] Foreign Application Priority Data

Jun. 26, 1980 [DE] Fed. Rep. of Germany ..... 3023980
Feb. 11, 1981 [DE] Fed. Rep. of Germany ..... 3104745

[51] Int. Cl.[4] ..... F42B 13/16
[52] U.S. Cl. ..... 102/521
[58] Field of Search ..... 102/520–523

[56] References Cited

U.S. PATENT DOCUMENTS

| | | | |
|---|---|---|---|
| 2,775,943 | 1/1957 | Ehsugian | 102/523 |
| 2,996,011 | 8/1961 | Dunlap | 102/521 |
| 3,620,167 | 11/1971 | Romer et al. | 102/521 |
| 3,899,978 | 8/1975 | Luther et al. | 102/521 |
| 4,362,107 | 12/1982 | Romer et al. | 102/520 |

FOREIGN PATENT DOCUMENTS

| | | | |
|---|---|---|---|
| 754801 | 10/1970 | Belgium | 102/703 |
| 1808779 | 6/1970 | Fed. Rep. of Germany . | |
| 2039719 | 3/1971 | Fed. Rep. of Germany . | |
| 3023980 | 10/1986 | Fed. Rep. of Germany . | |

*Primary Examiner*—Harold J. Tudor
*Attorney, Agent, or Firm*—Klein & Vibber

[57] ABSTRACT

A subcaliber projectile has a small-diameter projectile body extending along and centered on an axis, having a radially outwardly directed outer surface, and adapted to move in a predetermined axial back-to-front direction, and a sabot formed of a plurality of similar segments annularly surrounding at least a portion of the body, the segments forming an inner surface generally on the outer surface of the body and having an extreme front end and an extreme rear end. This projectile is formed on one of these surfaces at the extreme rear end of the sabot with a radially projecting ridge of generally semicircular shape having a center of curvature. The other of the surfaces is formed at the extreme rear end of each segment of the sabot with a radially open recess complementary to and receiving the ridge. In addition the segments are pivotal about the center of curvature without the ridge leaving the recess from a position with the respective inner surface lying on the outer projectile-body surface and a position with the inner surface projecting at an angle away therefrom.

4 Claims, 1 Drawing Sheet

SUBCALIBER PROJECTILE WITH PIVOTALLY SEPARABLE DRIVE CAGE

CROSS REFERENCE TO RELATED APPLICATION

This application is a divisional of application Ser. No. 809,476 now U.S. Pat. No. 4,724,770) which is a continuation-in-part of my patent application Ser. No. 280,378 filed June 22, 1981 (now abandoned).

FIELD OF THE INVENTION

The present invention relates to a subcaliber projectile. More particularly this invention concerns such a projectile having a multipart drive cage or sabot.

BACKGROUND OF THE INVENTION

A standard subcaliber projectile has a projectile body normally of a relatively hard armor-piercing material and a drive cage or sabot surrounding this body. The projectile body is of a diameter or caliber substantially smaller than the barrel from which the projectile is fired, and the sabot is of substantially larger diameter and fits complementarily in the barrel of the gun from which the projectile is fired. The sabot serves to transmit the force of the propellant to the projectile body, and is constructed to separate from the body after leaving the muzzle so that the body presents substantially less air resistance. Thus a subcaliber projectile can be fired at extremely high muzzle velocities for good armor-piercing capacities and long range.

The separation of the sabot from the body must be uniform so that the body is not deflected from its intended trajectory. If, for instance, a piece of the sabot remains stuck to the body on the underside thereof after the remaining pieces of the sabot separate, the aerodynamics of the flight of the projectile body will be changed to cause it to fall short of its target. At the worst the projectile body can be set tumbling, making it largely ineffective.

In Belgian Pat. No. 754,801 the sabot is spool shaped and formed of two or three identical sector segments forming a cylindrical passage closely surrounding the projectile body and centered of course on the axis defined by this body. Somewhat ahead in the normal flight direction of the projectile of the extreme rear end of the sabot the projectile body is formed with a radially outwardly open semicircularsection groove in which complementary parts or formations of the sabot segments fit. This groove is provided as far forward on the projectile body as possible to prevent crushing of the projectile body, its function being to transmit axial forces from the propellant to the projectile body. On leaving the muzzle of the barrel the rings holding the sabot segments self-destruct, permitting these segments to separate radially outward. As soon as the radially inwardly projecting formations of the seegments and the groove separate completely, the segments fall back away from the projectile body.

In U.S. Pat. No. 2,775,943 of Eksergian the sabot is joined to the projectile body by engagement of a radially inwardly projecting ridge in a complementary outwardly open groove. Once again this arrangement uses radial separation of the sabot from the projectile. The interfitting groove and ridge are well forward of the rear end of the sabot so if the segments thereof are levered out with their front ends separating from the projectile body while their rear ends remain in contact therewith, as soon as the groove and ridge pull apart there will be axial sliding and general disengagement. As a result this system, like that of the above-discussed Belgian patent, will not ensure rapid and even separation of the sabot segments from the projectile body, and in fact will allow them to slide back on it once they are separated. Thus lateral deflection of the projectile body by the separating sabot is likely.

Similarly, U.S. Pat. Nos. 3,620,167 and 4,362,107 both of Romer have arrangements wherein the front part of the sabot is axially forwardly and radially inwardly concave to act as an air scoop so that trapped air drives the front ends of the sabot segments radially outward. In this arrangement the sabot segments are adhered to a sealing disk that is fixed to the projectile, so that once again these sabot segments can relatively easily interfere with the projectile body during separation and deflect it from its trajectory.

OBJECTS OF THE INVENTION

It is therefore an object of the present invention to provide an improved subcaliber projectile.

Another object is the provision of such a subcaliber projectile which overcomes the above-given disadvantages, that is whose sabot separates evenly and surely from the projectile body without interfering with its trajectory at all.

A further object is to further the principles and ideas of the parent application, and in particular to provide excellent force transmission between the sabot and the projectile body during firing and accurate separation after leaving the muzzle.

SUMMARY OF THE INVENTION

A subcaliber projectile has a small-diameter projectile body extending along and centered on an axis, having a radially outwardly directed outer surface, and adapted to move in a predetermined axial back-to-front direction, and a sabot formed of a plurality of similar segments annularly surrounding at least a portion of the body, the segments forming an inner surface generally on the outer surface of the body and having an extreme front end and an extreme rear end. This projectile is formed according to this invention on one of these surfaces at the extreme rear end of the sabot with a radially projecting ridge of generally semicircular shape having a center of curvature. The other of the surfaces is formed at the extreme rear end of each segment of the sabot with a radially open recess complementary to and receiving the ridge. In addition the segments are pivotal about the center of curvature without the ridge leaving the recess from a position within the respective inner surface lying on the outer projectile-body surface and a position with the inner surface projecting at an angle away therefrom.

The segments can each be formed with a bump and the bumps together can form the ridge. Similarly, the recess can have a plurality of discrete sections respectively receiving the bumps of the segments. In such case each recess can be formed as a part-cylindrical groove centered on an axis extending chordally of the projectile body in a plane perpendicular to the axis thereof.

With such an arrangement the sabot segments separate from the projectile body in an accurately controlled and extremely uniform manner. Thus they will not deflect the projectile from its desired trajectory.

In accordance with further features of this invention the ridge and projection are made of a material of lower density, lower fusion point, and greater affinity for oxygen than the projectile body. This material can be a multiphase material, can have at least one metalloid phase, can be at least partially a synthetic resin, or at least partially magnesium. The material can be partially of a mineral, such as hollow glass spheres.

DESCRIPTION OF THE DRAWING

The above and other features and advantages will become more readily apparent from the following, it being understood that any feature described with reference to one embodiment of the invention can be used where possible with any other embodiment. In the accompanying drawing.

SPECIFIC DESCRIPTION

Figure 1:
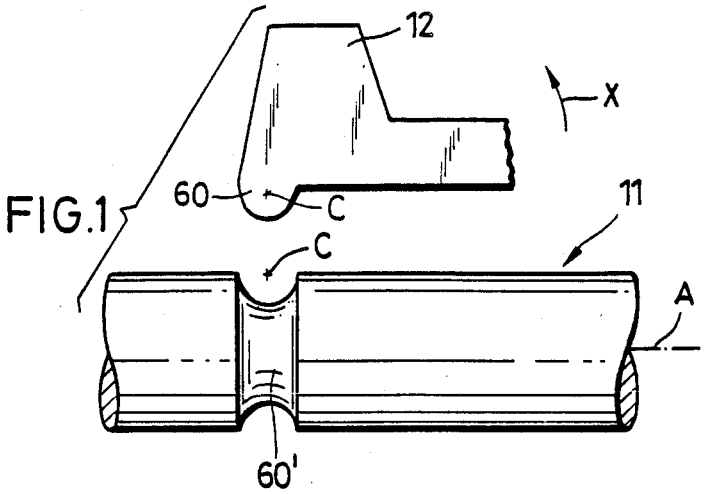
FIG. 1 is a side view of a center part of a projectile according to this invention.

As seen in FIG. 1 a subcaliber projectile according to this invention has a plurality of identical sabot-forming segments 12 and a cylindrical projectile body 11 centered on a projectile axis A. The segments 12 are formed at their extreme rear ends with radially inwardly projecting semicircular-section bumps 60 that together form a discontinuous radially inwardly projecting ridge and the body 11 is formed with a complementary radially outwardly open semicircular-section groove or recess 60'. In use the bumps 60 fit snugly in the groove 60' with the centers of curvature C of these formations coinciding. Thus, after leaving the muzzle of the barrel from which the projectile 11, 12 is fired, the segments 12 pivot back as indicated by arrow X, rocking about the centers C. Such action ensures rapid and regular separation of these segments 12 so that the trajectory of the projectory body 11 is not disturbed.

Figure 3:
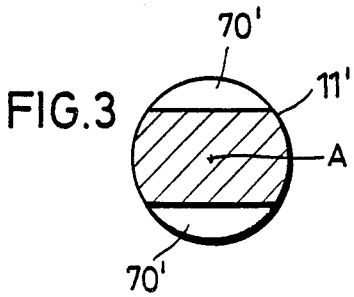
FIG. 3 is a section taken along line III—III through the projectile body of FIG. 2.
Figure 2:
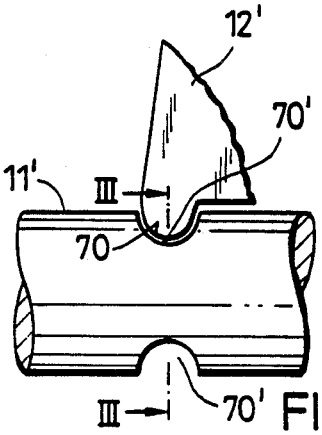
FIG. 2 is a side view of a second system according to this invention.

In FIGS. 2 and 3 a similar system is used, but here two segments 12', of which only one is shown, are used. These segments 12' have semicylindrical bumps 70 and the projectile body 11' is formed with a pair of grooves or recesses 70' of complementary semicylindrical shape, centered on respective axes extending chordally of the cylindrical projectile body 11' and in a plane perpendicular to its axis A. Thus in this arrangement the two sabot segments 12' will pivot out diametrically oppositely. The considerable surface contact afforded by the semicylindrical shape of the bumps 70 and recesses 70' gives good force transmission during firing and good separation control after firing.

Figure 4:
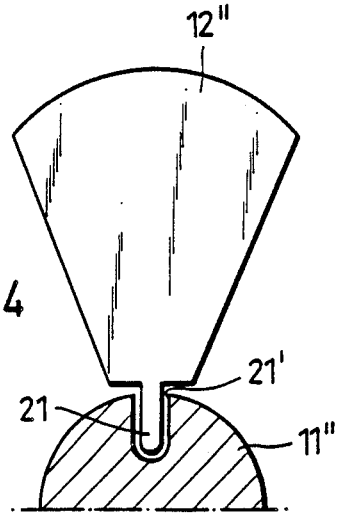
FIG. 4 is a cross section through a third projectile according to this invention.

In a variation on the system of FIGS. 2 and 3 as shown in FIG. 4, the segments 12'', which can number six, have short semicylindrical tabs or projections 21 that fit in complementary angularly delimited pockets 21' of the projectile body 11''. The fit of the tab 21 in the pocket 21' ensures excellent guiding of the sabot segment 12'' as it separates from the projectile body 11'' so that it will not interfere with its flight.

I claim:

1. In a subcaliber projectile having a small-diameter projectile body extending along and centered on an axis, having a radially outwardly directed outer surface, and adapted to move in a predetermined axial back-to-front direction; and a sabot formed of a plurality of similar segments annularly surrounding at least a portion of the body, the segments jointly forming an inner surface generally on the outer surface of the body; said segments having an extreme front end and an extreme rear end, said inner and outer surfaces forming a detachable connection, the improvement wherein a portion of said inner surface is radially inwardly forming a discontinuous projecting ridge at the extreme rear end of the sabot of generally semicircular cross-section and which has a center of curvature;

a portion of the outer surfaces is formed at the extreme rear end of each segment of the sabot with a radially open semi-circular groove complementary to and receiving said ridge and having substantially the same center of curvatures as said ridge, said centers of curvature being disposed at a radial distance from the axis of said projectile body; and the segments are pivotal over a predetermined angular range about the center of curvature without the ridge leaving the recess from a position with the respective inner surface portion lying on the outer projectile-body surface portion.

2. The subcaliber projectile defined in claim 1 wherein the segments are each formed with a bump and the bumps together form the ridge.

3. The subcaliber projectile defined in claim 2 wherein the groove has a plurality of discrete sections respectively receiving the bumps of the segments.

4. The subcaliber projectile defined in claim 3 wherein each recess is formed as a part-cylindrical groove centered on an axis extending chordally of the projectile body in a plane perpendicular to the axis thereof.

* * * * *